US006607786B2

(12) United States Patent
Katagiri et al.

(10) Patent No.: US 6,607,786 B2
(45) Date of Patent: Aug. 19, 2003

(54) METHOD OF CURTAIN COATING

(75) Inventors: Yoshinobu Katagiri, Kanagawa (JP); Yasuhiko Tokimasa, Kanagawa (JP); Yasushi Suga, Tokyo (JP); Yoshihisa Noguchi, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/082,137

(22) Filed: Feb. 26, 2002

(65) Prior Publication Data

US 2002/0160121 A1 Oct. 31, 2002

(30) Foreign Application Priority Data

Feb. 28, 2001 (JP) ..... 2001-054481

(51) Int. Cl.[7] ..... B05D 1/30; B05D 1/34
(52) U.S. Cl. ..... 427/314; 427/402; 427/420
(58) Field of Search ..... 427/420, 314, 427/402; 118/DIG. 4

(56) References Cited

U.S. PATENT DOCUMENTS 4,942,068 A * 7/1990 Schweicher et al. ..... 427/420

FOREIGN PATENT DOCUMENTS

| | | |
|---|---|---|
| JP | 10-137672 | 5/1988 |
| JP | 3-143569 | 6/1991 |
| JP | 3-146172 | 6/1991 |
| JP | 5-104061 | 4/1993 |
| JP | 6-503752 | 4/1994 |
| JP | 2835659 | 10/1998 |
| JP | 2000-070810 | * 3/2000 |

* cited by examiner

*Primary Examiner*—Katherine A. Bareford
(74) *Attorney, Agent, or Firm*—Sughrue Mion, PLLC

(57) ABSTRACT

In curtain coating for multiple layers consisting of lower most layer, uppermost layer and intermediate layer, using coating liquid having viscosity more than 300 mPas for one layer or more of multiple layers improves amazingly the curtain coating stability against disturbance such as passing spliced portion of running web. The one layer or more layers for which coating liquid having viscosity more than 300 mPas is to be used is selected from intermediate layer. The curtain coating stability is further improved by combining the high viscosity coating liquid for intermediate layer with other technologies such as electrifying web, heating web upstream of coating point and/or keeping web tension higher than some specified value.

10 Claims, 3 Drawing Sheets

METHOD OF CURTAIN COATING

FIELD OF THE INVENTION

This invention relates to a method of curtain coating for coating a variety of coating liquid on a running web, particularly a method for providing a high speed stable coating to a spliced portion of the web. The method is suitable for manufacturing photographic film, photographic paper, pressure sensitive paper, thermal recording paper, ink jet paper and the like.

BACKGROUND OF THE INVENTION

Curtain coating is performed by forming a free falling liquid curtain which impinges on a running web. The curtain coating is capable of making higher speed coating of simultaneous multiple layer than slide bead coating or slot (extrusion) coating because free-falling and impinging curtain has more ability of removing an entrained air in the boundary layer on the running web than slide bead coating or slot coating.

Many proposals for resolving problems of such air entrainment and liquid puddle formed at the impingement point of the curtain on the side of the approaching web have been presented. For example, Japanese Laid-open Patent Publication 146172/91 (tokkai-hei 3-146172) shows curtain coating for kind-of rough surface web using a lowermost layer having a viscosity more than 90 mPas at low shear rate and relatively lower viscosity at high shear rate in addition to keeping an average viscosity of all the layers more than 80 mPas. Japanese Laid-open Patent Publication 143569/91 (tokkai-hei 3-143569) shows that curtain coating for smooth surface web using a coating liquid having a viscosity between 50 and 100 mPas at low shear rate. PCT National Publication No. 503752/94 (tokuhyou-hei 6-503752) shows curtain coating using a lowermost layer having a viscosity more than 20 mPas at shear rate less than 500 $S^{-1}$ and less than 10 mPas at shear rate more than $10^6$ $S^{-1}$. There are many other proposals also focusing on optimizing a viscosity of lowermost layer. Other methods, for example, in Japanese patent 2835659, suggest heating or electrically charging the web to improve high speed coating stability.

Proposals mentioned above are useful to carry out high speed coating but still not sufficient to provide stable coating on a spliced portion of continuously web running at the speed around or more than 300 m/min. Instability or turbulence of coating curtain is caused by passing a spliced portion where a trailing end of old web and a leading end of new web are butted and spliced with splicing (adhesive) tape, more precisely by passing step formed by a trailing edge of the splicing tape and the web surface, which allows air entrainment, puddling and/or slipping of coating liquid and result in forming non-uniform coating thickness portion on the web. Thicker portion can not be dried completely by passing drying zone section, which contaminates web-transporting rollers and causes adhesion between the webs after being wound. Japanese Laid-open Patent Publications 104061/93 (tokkai-hei 5-104061) and 137672/98 (tokkai-hei 10-137672) show charging the spliced portion or electrifying the spliced portion with higher voltage charge than other portion. Those methods are still not perfect to avoid instability caused by the spliced portion.

SUMMARY OF THE INVENTION

An object of the invention is to provide method of high speed coating with keeping high stability in spite of spliced portion passing.

It is known that curtain coating is capable of applying more viscous liquid to a web than slide bead coating and viscosity able to be applied by curtain coating is normally between 1 and 200 mPas. We found, however, using coating liquid having viscosity more than 300 mPas, which had been unexpected value, to one or more layer of multiple layers improves amazingly curtain coating stability against disturbance such as passing spliced portion of the web. In addition to that, the one or more layers for which coating liquid having viscosity more than 300 mPas is to be used is selected from intermediate layer, although most of conventional studies to improve coating stability had been focused on optimization of liquid property of uppermost and/or lowermost layer, and the property of intermediate layer had been thought insignificant. It was also found that curtain coating stability is further improved by combining the fact mentioned above with other technologies such as electrifying web, heating web upstream of coating point and/or keeping web tension higher than some specified value. The invention is briefly explained below. Here, the term "viscosity" is defined as that measured at shear rate of 10 $S^{-1}$ unless otherwise defined.

Main part of the invention is as follows.

In method of curtain coating for applying simultaneously multiple layers to a running web, the multiple layers includes a lowermost layer, a uppermost layer and an intermediate layer which includes at least one layer made from coating liquid having viscosity more than 300 mPa. In method of curtain coating for applying simultaneously multiple layers to a running web, the multiple layers includes a lowermost layer, a uppermost layer and an intermediate layer which includes at least one layer made from coating liquid having viscosity more than 300 mPa, and a total flow rate of coating liquid having viscosity more than 300 mPas for the intermediate layer is less than 25% of a total flow rate of coating liquid for all the multiple layers.

Other factors usable to constitute the invention are below. The web includes a spliced portion where an old web and a new web are butted and spliced with an splicing tape, and each surface potential of the splicing tape and the web at least near the spliced portion is between 0.5 and 2.5 kV. The total flow rate of coating liquid having viscosity more than 300 mPas for intermediate layer is preferably between 5 and 15% of the total flow rate of coating liquid for all the multiple layers. The coating liquid having viscosity more than 300 mPas for intermediate layer preferably has a viscosity between 80 and 300 mPas at shear rate 1000 $S^{-1}$. The coating liquid having viscosity more than 300 mPas for intermediate layer preferably has a viscosity between 300 and 500 mPas and a viscosity of each coating liquid for other layers of the multiple layers is preferably less than 200 mPas. The web is preferably heated so that the web can keep its surface temperature between 30 and 50° C. at the point where a free falling curtain impinges the web. A tension applied to the web around a backing roller is recommended to be more than $8\times10^5$ $N/m^2$.

DETAILED DESCRIPTION OF THE INVENTION

Figure 1:
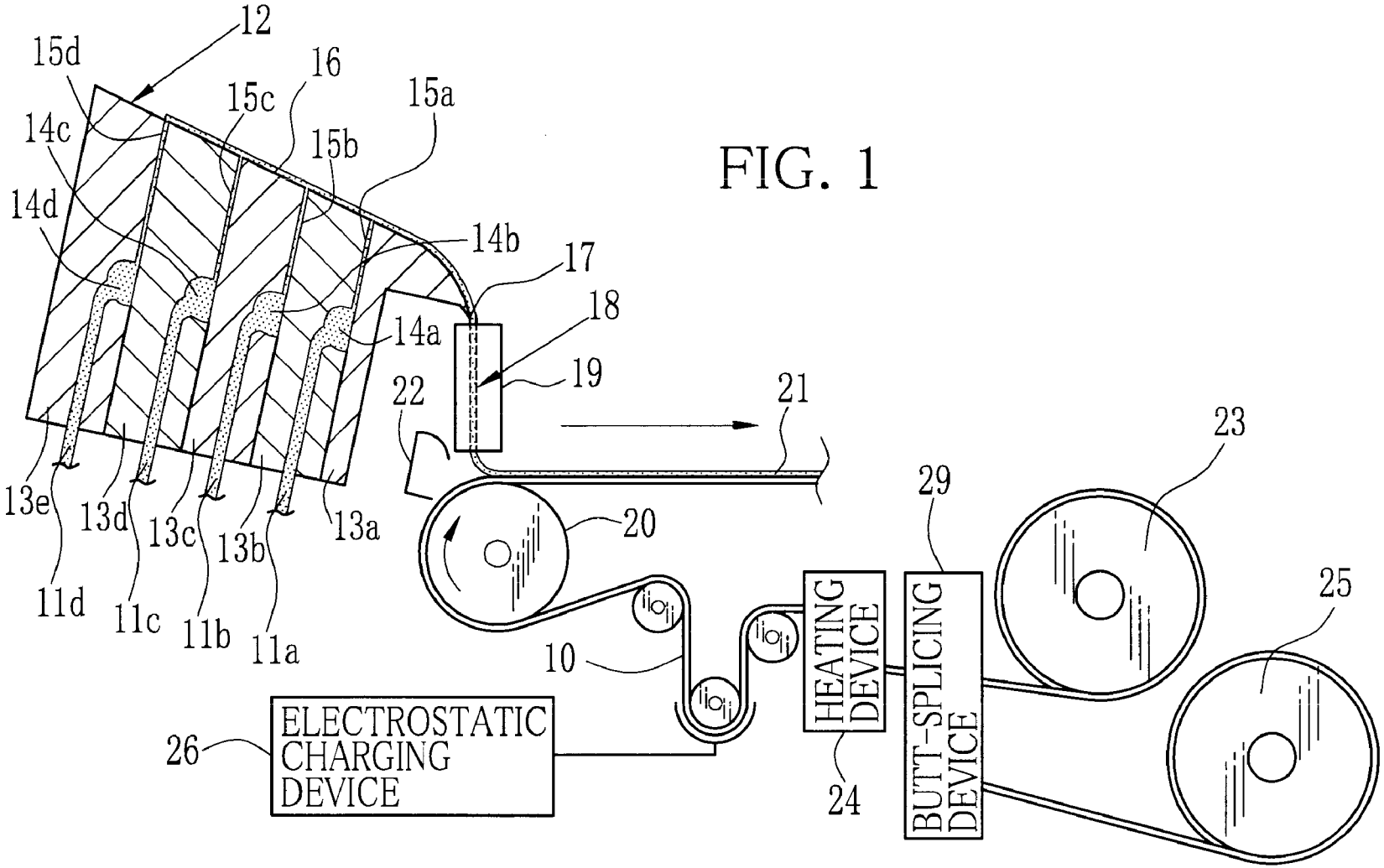
FIG. 1 shows manufacture line using multi-slide hopper type curtain coater where four layers are simultaneously applied to a running web.
Figure 2:
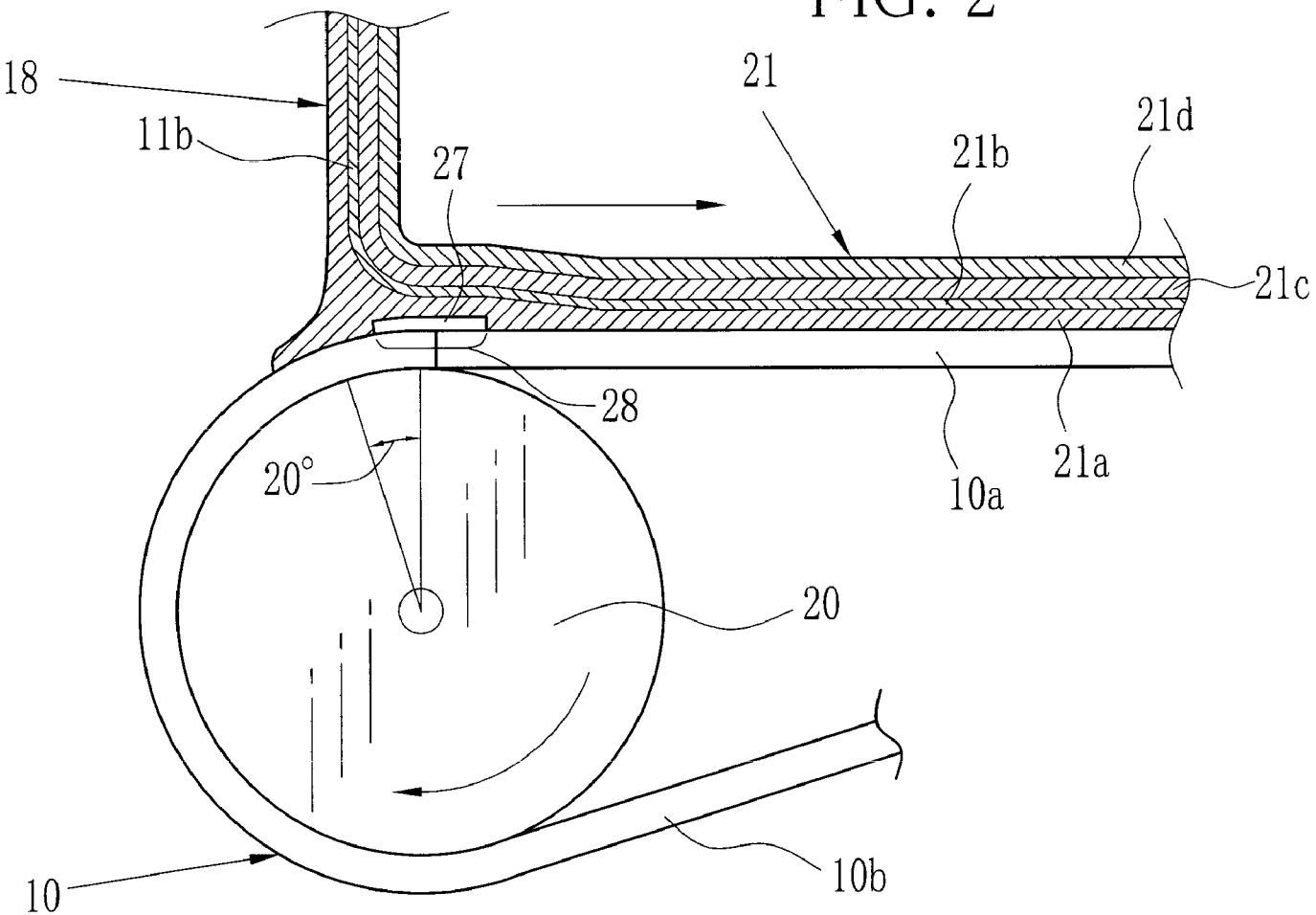
FIG. 2 is an enlarged fragmentary cross sectional view showing a coating point area.

In the invention, it is required that at least three layers are simultaneously applied. FIG. 1 shows manufacture line using multi-slide hopper type curtain coater where four layers are simultaneously applied to a running web. FIG. 2 is an enlarged fragmentary cross sectional view showing a coating point area. Four coating liquids 11*a*–11*d* for each four layer to be applied to a web 10 are fed to each cavity 14*a*–14*d* of die blocks 13*a*–13*e* constituting curtain coater 12 by variable metering pumps (not shown). Feeding position where the coating liquid 11 is fed into the cavity 14 can be either at its center area in width direction (center feeding) as shown in FIG. 1 or at one side (side feeding). The cavity has the largest cross sectional area at the feeding position and the area reduces toward both sides of the cavity in the case of center feeding or toward the other side in case of side feeding so that the formation of stagnant region can be avoided. Coating liquid feeding path increases its cross sectional area toward the cavity and avoids sharp bending in the vicinity of feeding position.

Each coating liquids 11*a*–11*d* fed into cavities 14*a*–14*b* is extruded through narrow vertical slots 15*a*–15*d* respectively out onto the downwardly inclined slide surface 16. Clearance and length of the slot 15, and cross sectional area of the cavity 14 are designed to form a uniform distribution of coating liquid flow rate in width direction of web. The slot clearance is normally between 0.2 and 1.0 mm. The slot length may have length distribution to improve the flow rate distribution. Total height of the slot 15 and the cavity 14 should be approximately ½ of height of the die block 13 in terms of accuracy in machining the die block. The slot clearance may be widen in the end area toward the slide surface to avoid flow turbulence and eddies because of sharp change of flow direction.

Each coating liquids 11*a*–11*d* extruded respectively out onto the downwardly inclined slide surface 16 is superimposed to form multi-layer while flowing down the inclined slide surface 16 and then form a multi-layer free-falling curtain after leaving a lip edge 17. Degree of the inclined surface 16 is between 10° and 30° except for lip edge portion 17 where the degree of inclination is between 30° and 90°. Surface of the lip edge portion 17 with steeper inclination and other surface portion 16 with relatively gentle inclination are connected with curved surface to avoid disturbing the flow of superimposed multi-layer. The multi-layer curtain freely falls by 3–25 cm while being held by edge guides 19 at its both side and impinges on the running web 10 backed by a backing roller 20 to form coated layer 21.

The backing roller is made of metal or coated with ceramics to avoid leakage of electric charge from the web as shown in Japanese Laid-open Patent Publication 251266/90 (tokkai-hei 2-251266). Lubricating fluid with low viscosity can be flown along the guide edge 19 to keep the liquid curtain 18 held stable. The lubricating fluid is fed into between the guide edge 19 and the free-falling curtain 18 from outer side of upper portion of the guide edge as shown in Japanese Laid-open Patent Publication 207229/99 (tokkai-hei 11-207229). Also air shielding device can be used by placing upstream of impinging point (coating point) where the curtain impinges on the running web 10) to avoid the air entrainment and wind caused therefrom. As examples of the air shielding devices, Japanese patent 2767712 shows suction type air shield and Japanese Laid-open Patent Publication 123658/91 (tokkai-hei 3-123658) shows air shielding plate with arcuate plate along the peripheral of the backing roller. Other known air shielding devices are to be used.

In the manufacture of coating products, it is usually necessary to use a plurality of rolled web to perform continuous operation to complete an amount of one batch. For precise coating, an old web 10*a* and a new web 10*b* are butted and spliced by a butt-splicing device 24 using a splicing tape 27 (shown in FIG. 2) to restrain total thickness change of the web as much as possible. The splicing tape should also be as thin as possible. Practically, however, the tape of which total thickness including base and adhesive layer is more than 40 μm should be used to keep sufficient splice.

The web 10 and the spliced portion (including a splicing tape and end portions of old and new web thereunder) are electrified between 0.5 and 2.5 kV by an electrostatic charging device 26 upstream of coating point where free-falling curtain impinges. It is preferable to avoid charging more than 2.5 kV because it tends to cause discharging. FIG. 1 shows charging by a direct current corona discharge using a wire electrode as disclosed in Japanese Laid-open Patent Publication 65088/92 (tokkai-hei 4-65088) and Japanese patent 2747837. In addition, other methods, for example, applying high voltage direct current to the backing roller 20 shown in Japanese Patent Publication 7050/74 (tokko-sho 49-7050) can be used.

When the spliced portion reaches the coating point, disturbance of curtain and air entrainment tend to arise because of sharp change of web thickness, i.e. upward step at the leading edge of splicing tape and downward step at the trailing edge, and the fact that the spliced portion tends to slightly float up off the backing roller surface at high speed running often enhances the sharp change.

Such disturbance of curtain and air entrainment, and non-uniform coating thickness resulting therefrom are restrained by using coating liquid 11*b* of which viscosity is more than 300 mPas for a second layer 21*b*. It is preferable to keep a flow rate of coating liquid 11*b* for the second layer 21*b* less than 25% of total flow rate of coating liquids for four layers for the better result. Adding a thickner (viscosity increasing agent) to or increasing concentration of coating, or other conventional way can be taken to obtain coating liquid with viscosity more than 300 mPas. One of preferable way to increase the viscosity is to put the thickner continuously into a liquid feeding line slightly upstream of cavity of the curtain coater and mix the thickner-added liquid completely by in-line mixer before reaching the cavity. This method gives an advantage to obtain the desirable viscosity without increasing pressure head of total feeding line. Adding a binder hardening agent is not recommended because it may form extremely high viscosity portion of the coating liquid in the cavity after a long time residence there.

To use above mentioned viscosity-increased coating liquid for the intermediate layer can restrain coating disturbance caused by sharp change of apparent web thickness such as spliced portion passing. Even if the disturbance is caused slightly, the coating can become stable again shortly as long as using that liquid. Viscosity more than 300 mPas can exert effect but around 500 mPas would be upper limit from practical point of view of feeding liquid without any troubles caused in handling high viscosity liquid.

Stability of curtain coating is affected by not only the viscosity immediately before impingement on the web but also a viscosity of coated liquid immediately after the impingement where the coated liquid is rapidly drawn out by the running web. From this point of view, it is found that stability or resistivity against the disturbance is improved when the viscosity at higher shear rate reduces from that of lower shear rate but still keeps relatively high viscosity and the viscosity of coating liquid for one of intermediate layer, for example, second layer 21*b*, should be more than 80 mPas at shear rate 1000 $S^{-1}$.

When the viscosity of coating liquid 11*a* or 11*d* for the lowermost layer 21*a* or uppermost layer 21*d* is more than 300 mPas, or when the total flow rate of coating liquid having viscosity more than 300 mPas for the intermediate layer (second layer 21*b* in the embodiment) accounts for more than 25% of total flow rate of all the layers, curtain coating becomes unstable, which results in difficulty in uniform curtain formation and non-uniform coating not only at the spliced portion but in the rest of web. In this point of view, it is more preferable to choose the amount between 5 and 15% as total flow rate of coating liquids with viscosity more than 300 mPas for intermediate layer. It is also found that viscosity of coating liquids for other layers should be less than 300 mPas, preferably less than 200 mPas.

Viscosity of coating liquid for the lowermost layer 21*a* should preferably be less than 50 mPas at shear ate $10^4$ $S^{-1}$. If a central area average surface roughness (Ra) of the web is more than 0.3 $\mu$m, viscosity at low shear rate should preferably be more than 90 mPas as disclosed in Japanese Laid-open Patent Publication 146172/91 (tokka-ihei 3-146172) and if Ra is less than 0.3 $\mu$m, viscosity between 50 and 100 mPas is preferable to restrain the air entrainment as disclosed in Japanese Laid-open Patent Publication 143569/91 (tokkai-hei 3-143569). And ratio of viscosity between lowermost layer and adjacent layer thereto and/or ratio of flow rate between lowermost layer and total flow rate of all the layers should be optimized to improve a stability of the flow over the entire slide inclined surface.

The invention can be applied to coating liquids such as ones for photographic emulsion layer, non-photographic material layer and protective layer of photographic materials, pressure sensitive paper, thermal recording paper and ink jet paper. Those coating liquids usually contain a thickner to increase the viscosity by ion bonding between the binders. Surfactants are also contained, specially both the statistic and dynamic surface tensions of the uppermost layer and the lowermost layer are controlled to keep being lower than that of other layers by adding relatively large amount of surfactant or surfactant capable of keeping low dynamic surface tension.

Typical webs usable in the invention are cellulose acetate film, polyethylene terephthalate film, polyethylene naphthalate film, paper and polyethylene laminated paper. Usually subbing layer is formed on the webs to reinforce bonding between the web and the coated layer. Surface roughness of the web the invention can be applied widely ranges from less than 0.1 $\mu$m to around 15 $\mu$m in central area average surface roughness (Ra).

As for the splicing tapes, adhesive tapes of which bases are polyethylene terephthalate, polyethylene, paper and the like can be used. The splicing tapes may have subbing layer and/or black colored layer as a marker to detect the spliced portion.

It is preferable to keep the temperature of the spliced portion or all the web portion including the spliced portion being between 30° C. and 50° C. at the coating point where the curtain impinges the web to provide further stability of curatain coating against passing of the spliced portion. Heating of the web is carried out by a heating device 29 using hot air, heating roller, Infra-red heater or the like.

It happens from time to time that the spliced portion 28 slightly floats up from the surface of backing roller 20 at high speed running, which enhances the sharp change of apparent web thickness and/or reduces the electrostatic force to attract the curtain 18 to the web 10 because of air layer induced between the surface of the backing roller 20 and the back side of the web 10 under the spliced portion. This floating of spliced portion reduces the stability effect provided by using high viscosity liquid for intermediate layer and electrifying web. To avoid the floating phenomenon, it is preferable to keep the web tension being more than $8\times10^5$ $N/m^2$, which is effective in particular in using more than 1 m width web.

In the embodiment explained above, slide hopper type curtain coater is used. Extrusion type curtain coater can also be used without any additional problems.

Example 1 is explained below and other examples including comparative ones were carried out mostly under the same conditions as example 1 except some different conditions described in TABLE 1.

Example 1

Four layers, which were constituted by lowermost layer (first layer), intermediate layer (second and third layers) and uppermost layer (fourth layer), were simultaneously coated on a polyethylene laminated paper with subbing layer for photographic paper (glossy paper: total thickness of 200 $\mu$m, central area average surface roughness (Ra) of 0.3 $\mu$m) by using a curtain coater shown in FIG. 1. Coating liquid 11 was prepared by adding thickner (polystyrene sulfonate with molecular weight of one million) to alkali-treated gelatin solution so as to obtain predetermined viscosity shown in TABLE 1. Coating liquids for lowermost layer (first layer in TABLE 1) and uppermost layer (fourth in TABLE 1) contained surfactant (di-2-ethylhexyl-á-sodium sulfosuccinate) by 0.13% by weight respectively, of which each surface tension was about 28 mN/m measured by Wilhelmy method. Coating liquids for second layer and third layer contain sodium dodecylbenzenesulfonate by 0.075% by weight, of which each surface tension was about 33 mN/m measured by Wilhelmy method.

Total wet coating thickness was 80 $\mu$m and flow rates for each of layers were adjusted to have predetermined wet thickness respectively according to web running speeds. The coating test was carried out under the following condition.

Web running speed: 300 m/min, 400 m/min and 500 m/min

Height of curtain 18: 120 mm

Coating point: 20 degree away from top toward upstream on the backing roller 20.

Surface potential: 2 kV on web and splicing tape (surface electrical charge: $8.4\times10^{-4}$ $C/m^2$ on the web, $5.0\times10^{-4}$ $C/m^2$ on the tape) electrified by corona discharging using wire electrodes to provide unipolar charge.

Spliced portion 28: butted and spliced, splicing tape 27: 50 mm width and 25 $\mu$m thickness polyethylene terephthalate base +25 $\mu$m thickness adhesive layer. Gap between old web and new one was less than 1 mm.

Coated web was transported through chilling air zone for setting and drying air zone for drying and then wound. Surface appearance and other coating quality were visually checked.

TABLE 1

| | Examples | | | | | | | | | | | |
|---|---|---|---|---|---|---|---|---|---|---|---|---|
| | Example 1 | | Example 2 | | Example 3 | | Example 4 | | Example 5 | | Example 6 | |
| First layer | V | FRR | V | FRR | V | FRR | V | FRR | V | FRR | V | FRR |
| Gel. conc. 5% | 150 | 10 | 150 | 10 | 150 | 10 | 150 | 10 | 150 | 10 | 150 | 10 |
| Second layer Gel. conc. 5% | 330 | 20 | 100 | 60 | 330 | 10 | 330 | 10 | 330 | 10 | 450 | 20 |
| Third layer Gel. conc. 5% | 100 | 60 | 330 | 20 | 100 | 70 | 100 | 70 | 100 | 70 | 100 | 60 |
| Fourth layer Gel. conc. 5% | 50 | 10 | 50 | 10 | 50 | 10 | 50 | 10 | 50 | 10 | 50 | 10 |
| FFR 300 | 20 | | 20 | | 10 | | 10 | | 10 | | 20 | |
| Web Temp. ° C. | 25 | | 25 | | 25 | | 35 | | 35 | | 25 | |
| Charge kV | 2 | | 2 | | 2 | | 2 | | 2 | | 2 | |
| Web Tension N/m$^2$ | $6 \times 10^5$ | | $6 \times 10^5$ | | $6 \times 10^5$ | | $6 \times 10^5$ | | $8 \times 10^5$ | | $6 \times 10^5$ | |
| Web Speed | Surface Appearance and Coating Quality visually checked | | | | | | | | | | | |
| 300 m/min | A | | A | | A | | A | | A | | A | |
| 400 m/min | A | | A | | A | | A | | A | | A | |
| 500 m/min | D | | D | | C | | B | | A | | D | |

TABLE 2

| | Comparative Examples | | | | | | | |
|---|---|---|---|---|---|---|---|---|
| | Comparative example 1 | | Comparative example 2 | | Comparative example 3 | | Comparative example 4 | |
| First layer | V | FRR | V | FRR | V | FRR | V | FRR |
| Gel. conc. 5% | 150 | 10 | 350 | 10 | 150 | 10 | 150 | 10 |
| Second layer Gel. conc. 5% | 330 | 30 | 170 | 40 | 170 | 40 | 250 | 20 |
| Third layer Gel. conc. 5% | 100 | 50 | 100 | 40 | 100 | 40 | 100 | 60 |
| Fourth layer Gel. conc. 5% | 50 | 10 | 50 | 10 | 50 | 10 | 50 | 10 |
| FFR 300 | 30 | | 10 | | 0 | | 0 | |
| Web Temp. ° C. | 25 | | 25 | | 25 | | 25 | |
| Charge kV | 2 | | 2 | | 2.5 | | 2 | |
| Web Tension N/m$^2$ | $6 \times 10^5$ | | $6 \times 10^5$ | | $6 \times 10^5$ | | $6 \times 10^5$ | |
| Web Speed | Surface Appearance and Coating Quality visually checked | | | | | | | |
| 300 m/min | A | | F2 | | A | | A | |
| 400 m/min | F1 | | F2 | | D | | C | |
| 500 m/min | F1 | | F2 | | D | | D | |

TABLE 1 shows examples 1–6 of the invention. TABLE 2 shows comprative examples 1–4. In TABLE 1 and 2, Notations represent as follows.

V: represents viscosity [mPas] at shear rate $10^{-1}$.

FRR: represents flow rate ratio [%] of coating liquid for the layer and total coating liquid for all the layers.

FRR300: represents flow rate ratio of coating liquid of which viscosity is more than 300 mPas and total coating liquid for all the layers.

A: represents uniform coating was made and drying was complete at the spliced portion.

B: represents slightly non-uniform coating was made but drying was complete at the spliced portion.

C: represents non-uniform coating was made and drying was partially incomplete at the spliced portion.

D: represents significantly non-uniform coating was made and drying was incomplete, which contaminated web transporting rollers and caused adhesion between the webs after being wound.

F1: represents coating in the lateral edge area of the web was incomplete over the entire web length.

F2: represents curtain formation was impossible.

First layer—Fourth layer: represent each coating liquid for first layer—fourth layer.

TABLE 1 indicates that, in examples 1, 2 and 3, stable (uniform)coating was obtained at the spliced portion even at the web speed of 400 m/min by using one intermediate layer (second layer or third layer) of which viscosity was more than 300 mPas (in the examples, 330 mPas). However, when the flow rate for the high viscosity (more than 300 mPas) layer was too much (beyond some amount) as in comparative example 1 in TABLE 2, curtain coating was unstable in lateral edge area of the web. When viscosity of coating liquid for the lowermost layer was too high (350 mPas) as in comparative example 2, stable curtain could not be formed. As shown in comparative example 3, mere increase of charging (surface potential) could not realize higher speed coating (400 m/min) with stable condition at the spliced portion. As shown in examples 4 and 5, increasing the temperature and tension of web made it possible to realize 500 m/min high speed coating without any defects including incomplete drying. In example 6, coating liquid with viscosity 450 mPas for second layer realized 400 m/min stable coating for the spliced portion. On the contrary, when 250 mPas liquid was used for the second layer, stable 400 m/min coating was not completed as shown in comparative example.

Figure 3:
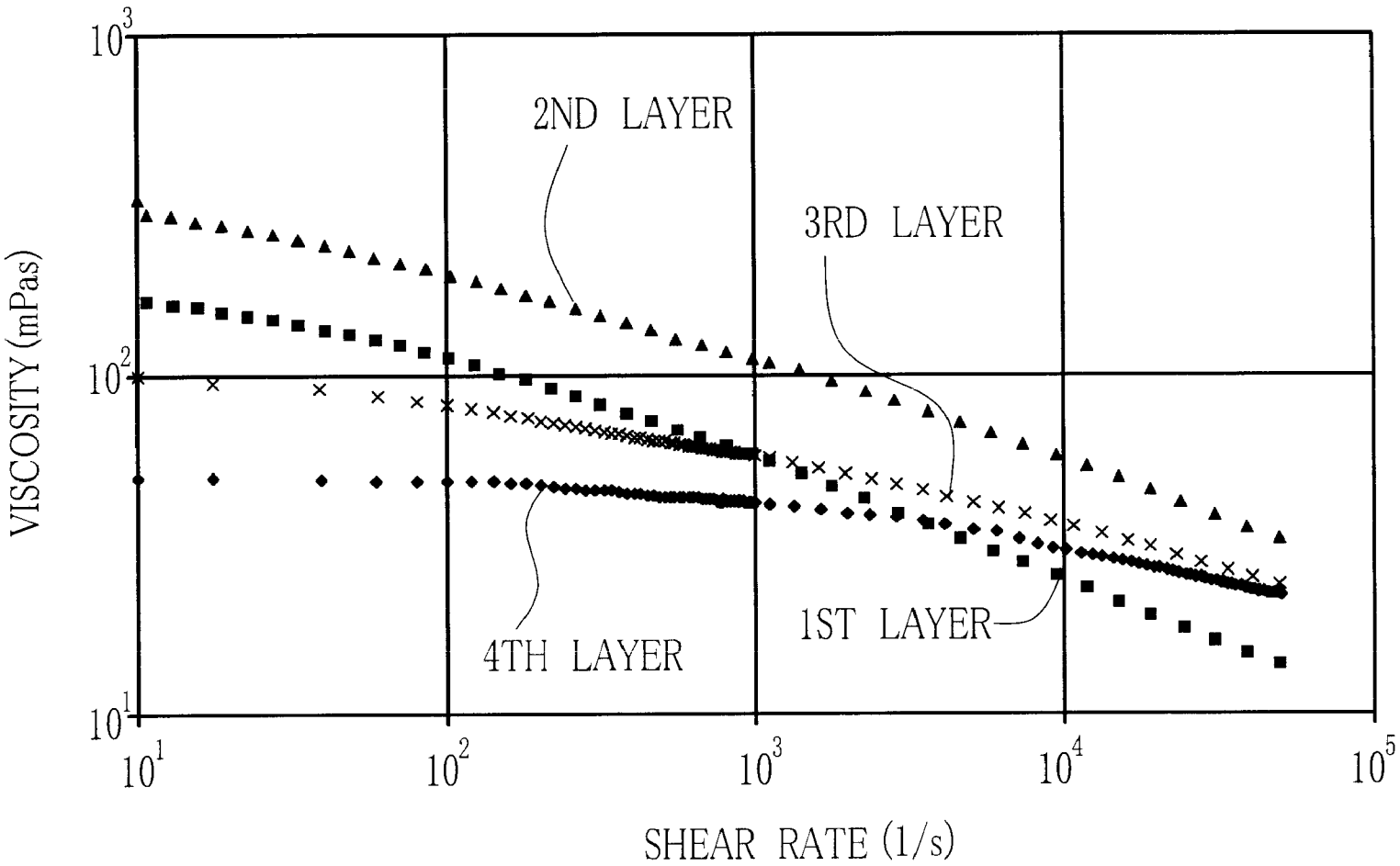
FIG. 3 is a graph showing the relation between viscosity and shear rate of coating liquids for four layers used in example 1.

FIG. 3 is a graph showing the relation between viscosity and shear rate of coating liquids for four layers used in example 1. Although viscosity of coating liquid for second layer reduced at higher shear rate 1000 $S^{-1}$ compared to one at low shear rate 10 $S^{31\ 1}$ (330 mPas), it sill kept relatively higher viscosity, 110 mPas. This property seems to enable coating immediately after free-falling curtain impingement on the web, where the coating liquid is rapidly drawn out, to keep stable. Actually the viscosity should be more than 80 mPas, particularly more than 100 mPas at shear rate 1000 $S^{-1}$ but around 500 mPas would be upper limit from practical point of view of feeding liquid without any troubles caused in handling high viscosity liquid.

Various changes and modifications are possible in the present invention and may be understood to be within the present invention.

What we claim is:

1. A method of curtain coating comprising:

applying plural coating liquids simultaneously to respectively form multiple layers on a running web, where the multiple layers include a lowermost layer, an uppermost layer, and at least one intermediate layer, wherein coating liquid forming at least one of the at least one intermediate layer has a viscosity of more than 300 mPas, and wherein a total flow rate of coating liquid forming all of the intermediate layers that have a viscosity of more than 300 mPas is less than 25% of a total flow rate of coating liquid forming all of the multiple layers.

2. Method according to claim 1, wherein the web includes a spliced portion where an old web and a new web are butted and spliced with an splicing tape, and each surface potential of the splicing tape and the web at least near the spliced portion is between 0.5 and 2.5 kV.

3. Method according to claim 2, wherein the web is heated so that the web surface temperature is between 30 and 50° C. at the point where a free falling curtain impinges the web.

4. Method according to claim 1, wherein the total flow rate of the coating liquids having viscosity more than 300 mPas is between 5 and 15% of total flow rate of coating liquid for all multiple layers.

5. Method according to claim 4, wherein the web is heated so that the web surface temperature is between 30 and 50° C. at the point where a free falling curtain impinges the web.

6. Method according to claim 1, wherein the coating liquid having viscosity more than 300 mPas for intermediate layer has a viscosity between 80 and 300 mPas at shear rate 1000 $S^{-1}$.

7. Method according to claim 6, wherein the web is heated so that the web surface temperature is between 30 and 50° C. at the point where a free falling curtain impinges the web.

8. Method according to claim 1, wherein the coating liquid having viscosity more than 300 mPas for intermediate layer has a viscosity between 300 and 500 mPas and a viscosity of each coating liquid for other layers of the multiple layers is less than 200 mPas.

9. Method according to claim 1, wherein the web is heated so that the web surface temperature is between 30 and 50° C. at the point where a free falling curtain impinges the web.

10. Method according to claim 1, wherein a tension applied to the web around a backing roller is more than $8\times10^5$ $N/m^2$.

* * * * *